US011807986B2

(12) United States Patent
Venema et al.

(10) Patent No.: US 11,807,986 B2
(45) **Date of Patent: *Nov. 7, 2023**

(54) PROCESS AND APPARATUS FOR WETLAYING NONWOVENS

(71) Applicant: Essity Hygiene and Health Aktiebolag, Gothenburg (SE)

(72) Inventors: Arie Venema, Suameer (NL); Gaatze Wijbenga, Noardburgum (NL); Hannu Ahoniemi, Gothenburg (SE); Mikael Strandqvist, Gothenburg (SE)

(73) Assignee: ESSITY HYGIENE AND HEALTH AKTIEBOLAG, Gothenburg (SE)

( * ) Notice: Subject to any disclaimer, the term of this patent is extended or adjusted under 35 U.S.C. 154(b) by 91 days.

This patent is subject to a terminal disclaimer.

(21) Appl. No.: 17/236,483

(22) Filed: Apr. 21, 2021

(65) Prior Publication Data

US 2021/0238804 A1 Aug. 5, 2021

Related U.S. Application Data

(63) Continuation of application No. 16/326,823, filed as application No. PCT/EP2016/070626 on Sep. 1, 2016, now Pat. No. 11,015,292.

(51) Int. Cl.
*D21F 11/00* (2006.01)
*D21F 1/66* (2006.01)
(Continued)

(52) U.S. Cl.
CPC ..... *D21F 11/002* (2013.01); *D04H 1/00* (2013.01); *D04H 1/732* (2013.01); *D21F 1/66* (2013.01); *D21H 15/02* (2013.01); *D21H 21/24* (2013.01)

(58) Field of Classification Search
CPC ... D21D 5/26; D21D 5/24; D21D 5/18; D21F 1/66; D21F 11/002; Y10S 162/07;
(Continued)

(56) References Cited

U.S. PATENT DOCUMENTS 3,206,917 A * 9/1965 Kaiser ..... D21D 5/26 95/266
3,421,622 A * 1/1969 Wurtmann ..... D21D 5/26 209/733
(Continued)

FOREIGN PATENT DOCUMENTS

CA 841938 A 5/1970
CA 2320189 A1 8/1999
(Continued)

OTHER PUBLICATIONS

Canadian Patent Office, Office Action issued in corresponding CA Application No. 3,034,508, dated Feb. 18, 2020 (3 pages).
(Continued)

*Primary Examiner* — Jose A Fortuna
(74) *Attorney, Agent, or Firm* — CANTOR COLBURN LLP

(57) ABSTRACT

A process and an apparatus for producing nonwoven materials are disclosed. The process includes the following steps:
a) providing a three-phase (gas-liquid-solid) suspension containing air, water, fibrous material and a surfactant,
b) depositing the suspension onto a moving carrier sieve to produce a fibrous web on the carrier sieve,
c) removing aqueous residue of the suspension through the carrier sieve,
d) conveying the aqueous residue through one or more phase separation tanks in an essentially horizontal direction while providing a depressurised headspace above the aqueous residue,
(Continued)

e) recycling the aqueous residue conveyed in step d) to step a),
f) preferably pre-integrating the fibrous web.

20 Claims, 2 Drawing Sheets

(51) Int. Cl.
*D04H 1/732* (2012.01)
*D21H 21/24* (2006.01)
*D04H 1/00* (2006.01)
*D21H 15/02* (2006.01)

(58) Field of Classification Search
CPC ..... Y10S 162/11; D21H 21/14; D21H 15/02; D04H 1/00; D04H 1/732; B01D 19/00; Y02P 70/62
See application file for complete search history.

(56) References Cited

U.S. PATENT DOCUMENTS 3,716,449 A 2/1973 Gatward et al.
3,871,952 A 3/1975 Robertson
4,219,340 A * 8/1980 Kaiser ..... D21D 5/26 95/266
4,238,208 A 12/1980 Frykhult et al.
4,419,109 A 12/1983 Matula
4,443,232 A 4/1984 Kaiser
4,478,615 A 10/1984 Kaiser
4,944,843 A 7/1990 Wallace et al.
5,268,077 A * 12/1993 Bubik ..... B01D 19/0047 96/197
5,403,442 A 4/1995 Henricson et al.
5,853,538 A * 12/1998 Reiner ..... D21F 11/002 162/190
5,868,905 A * 2/1999 Graf ..... D21D 5/26 96/204
6,103,060 A 8/2000 Munerelle et al.
6,416,632 B1 * 7/2002 Kirjasniemi ..... B01D 19/0042 96/182
6,425,986 B1 * 7/2002 Gmeiner ..... D21D 5/26 162/380
6,491,744 B2 * 12/2002 Binder ..... D21D 5/26 96/197
6,592,713 B2 7/2003 Ahoniemi
6,733,629 B1 5/2004 Matula
6,869,504 B2 3/2005 Hietaniemi
7,101,418 B2 * 9/2006 Beuermann ..... B01D 19/0047 95/266
7,214,257 B2 5/2007 Mannes
7,326,318 B2 * 2/2008 Strandqvist ..... D04H 1/495 428/172
7,331,091 B2 2/2008 Strandqvist
7,381,295 B2 * 6/2008 Kokkonen ..... D21D 5/26 96/182
7,406,755 B2 8/2008 Putnam et al.
7,432,219 B2 10/2008 Strandqvist et al.
7,998,889 B2 * 8/2011 Stralin ..... D04H 3/033 442/403
8,157,966 B2 * 4/2012 Parviainen ..... D21D 5/26 162/380
8,389,427 B2 * 3/2013 Gustafsson ..... D04H 1/43835 442/403
8,425,729 B2 * 4/2013 Skoog ..... D04H 1/498 162/361
8,763,219 B2 * 7/2014 Jonsson ..... D04H 5/03 28/104
9,394,637 B2 * 7/2016 Knowlson ..... B08B 1/006
9,840,794 B2 12/2017 Seidel et al.
10,435,826 B2 * 10/2019 Strandqvist ..... D04H 1/498
11,015,292 B2 * 5/2021 Venema ..... D21F 1/66
11,136,700 B2 * 10/2021 Venema ..... B08B 1/006
2002/0088099 A1 7/2002 Ahoniemi
2003/0192661 A1 10/2003 Elonen et al.
2005/0022954 A1 2/2005 Strandqvist
2005/0064099 A1 3/2005 Berenstain et al.
2005/0112980 A1 5/2005 Strandqvist et al.
2005/0278912 A1 * 12/2005 Westland ..... D04H 1/425 28/104
2007/0010156 A1 1/2007 Strandqvist
2009/0201975 A1 8/2009 Meinander et al.
2010/0075120 A1 * 3/2010 Gustafsson ..... D04H 5/08 156/73.2
2010/0126686 A1 5/2010 Parviainen et al.
2014/0090217 A1 * 4/2014 Jonsson ..... D04H 1/492 28/103
2015/0083354 A1 * 3/2015 Strandqvist ..... B32B 5/022 162/146
2018/0355527 A1 * 12/2018 Strandqvist ..... D21H 27/002
2018/0363177 A1 * 12/2018 Strandqvist ..... D04H 1/46
2018/0363182 A1 * 12/2018 Bergmann ..... D04H 1/495
2019/0177915 A1 * 6/2019 Venema ..... D21F 11/002
2019/0226133 A1 * 7/2019 Venema ..... D21F 11/04
2021/0238804 A1 * 8/2021 Venema ..... D21F 1/66

FOREIGN PATENT DOCUMENTS

CA 2320189 C * 8/2006 ..... B01D 19/0036
CA 2320189 C 8/2006
CA 3034510 A1 3/2018
CN 1122389 A 5/1996
CN 1127816 A 7/1996
CN 1137585 A 12/1996
CN 1245544 A 2/2000
CN 1277644 A 12/2000
CN 1277646 A 12/2000
CN 109642375 B * 6/2022 ..... B08B 1/006
DE 10120885 A1 11/2001
DE 102006027596 A1 8/2007
DE 102011076257 A1 * 11/2012 ..... D21D 5/26
EP 0330387 A2 8/1989
EP 0440455 A1 8/1991
EP 0481745 A1 4/1992
EP 0481746 A1 4/1992
EP 1735489 B1 9/2012
EP 3507408 A1 7/2019
EP 3507416 A1 7/2019
GB 755741 A 8/1956
GB 755973 A 8/1956
GB 2008644 A 6/1979
JP 2002285466 A 10/2002
SU 1384210 A3 3/1988
WO 8605708 A1 10/1986
WO 9602701 A1 2/1996
WO 9602702 A1 2/1996
WO 9715717 A1 5/1997
WO 9827276 A1 6/1998
WO 9939047 A1 8/1999
WO 0181675 A1 11/2001
WO 0222946 A1 3/2002
WO 2005042819 A1 5/2005
WO 2005059218 A1 6/2005
WO 2005087997 A1 9/2005
WO WO-2006060398 A2 * 6/2006 ..... D04H 13/005
WO 2007107635 A1 9/2007
WO 2010077929 A1 7/2010
WO WO-2012056108 A1 * 5/2012 ..... D21C 5/025
WO 2013165287 A1 11/2013
WO 2016041773 A1 3/2016
WO 2018041355 A1 3/2018
WO 2018041356 A1 3/2018

OTHER PUBLICATIONS

Canadian Patent Office, Office Action issued in corresponding CA Application No. 3,034,510, dated Dec. 23, 2019 (3 pages).
Chinese Patent Office, Office Action issued in corresponding CN Application No. 201680088830.1, dated Mar. 2, 2020 and English Translation of same (16 pages).

(56) References Cited

OTHER PUBLICATIONS

European Patent Office, Search Report and Written Opinion issued in corresponding PCT Application No. PCT/EP2016/070626, dated May 8, 2017 (10 pages).
European Patent Office, International Search Report and Written Opinion issued in corresponding PCT Application No. PCT/EO2016/070627, dated Apr. 26, 2017 (12 pages).
European Patent Office, Office Action issued in corresponding EP Application No. 16 763 735.4-1102 dated Dec. 18, 2019 (4 pages).

* cited by examiner

PROCESS AND APPARATUS FOR WETLAYING NONWOVENS

CROSS-REFERENCE TO RELATED APPLICATIONS

This application is a continuation of U.S. patent application Ser. No. 16/326,823, filed on Feb. 20, 2019, now issued as U.S. Pat. No. 11,015,292, which is a national stage application under 35 U.S.C. § 371 of International Application No. PCT/EP2016/070626, filed on Sep. 1, 2016, the disclosures of which are hereby incorporated by reference herein in their entireties.

TECHNICAL FIELD

The present disclosure relates to a process for producing a fibre-containing nonwoven sheet material and to an apparatus for incorporating the fibre into the sheet material through foam formation.

BACKGROUND

Absorbent nonwoven materials are used for wiping various types of spills and dirt in industrial, medical, office and household applications. They typically include a combination of thermoplastic polymers (synthetic fibres) and cellulosic pulp for absorbing both water and other hydrophilic substances, and hydrophobic substances (oils, fats). The nonwoven wipes of this type, in addition to having sufficient absorptive power, are at the same time strong, flexible and soft. They can be produced by wetlaying a pulp-containing mixture on a polymer web, followed by dewatering and hydroentangling to anchor the pulp onto the polymer and final drying. Absorbent nonwoven materials of this type and their production processes are disclosed e.g. in WO2005/042819.

An improvement in wet-laying fibrous nonwovens involves using a foam instead of a purely aqueous slurry, since this results in a reduced consumption of water and in a reduced capital investment. WO96/02701 and WO96/02702 disclose a method of producing a hydroentangled nonwoven material by foam formation of a fibrous web, followed by spraying the foam-formed web with water.

WO98/27276 discloses a method of producing a nonwoven sheet material wherein a slurry of fibre, surfactant in water and air is pumped onto a wire material to allow the fibre to be attached to the wire material so as to produce a non-woven web of fibre onto the wire material, and the fibre-free slurry is then recycled to the foam production stage. The pumps used for transporting the foam are degassing pumps, in order to prevent the pumps from being stuck by the presence of air. Thus, WO98/27276 employs a short circulation using high flows (40,000 l/min) in the formation loop and a much smaller long circulation of 3,500 l/min for dosing fibres to be transported to the short circulation, where it is diluted to contain the desired conditions (50-80% of air) for forming the web. The process is used for producing sheet material of more than two meters wide.

EP 0481746 discloses a process of producing a fibrous sheet material by foam formation, in which surfactant is recovered from the spent foam, by removing bubbles and draining liquid from the foam and returning the surfactant-rich foam to the foam laying step. This process also involves both a short circulation (formation loop) and a long circulation (foam conditioning loop, i.e. extracting surfactants and removing surplus water) in the formation and dewatering systems.

The prior art processes for producing pulp-containing nonwovens using foam formation use high air contents in the order of 50-80 vol. %. Such high air levels are more difficult to pump, because they make the foam more easily compressible. Also, these high air levels cause the foam to collapse easily at low flow rates. Hence prior art processes demand high flow rates to maintain the high air content. As a consequence, pumps, tanks and piping need to be scaled up and energy consumption is high. Furthermore, the prior art processes, such as described in WO 98/27276 and EP0481746, use different circulations, making the processes complicated.

There is a need for a process and an apparatus for producing non-woven sheet material allowing the use of higher proportions of relatively long fibres and higher levels of fibres compared to the amount of water used in the wet-laying process, while avoiding the need for expensive and high-maintenance pumps.

SUMMARY

It is desired to provide a process for producing a, preferably hydroentangled, absorbent fibre-containing nonwoven material using a three-phase fibre-containing suspension, i.e. a foam, and efficiently upgrading and recycling aqueous residue of the suspension.

It is also desired to provide an apparatus for degassing and recycling aqueous residues from the deposition three-phase suspensions.

The presently disclosed process and the apparatus have the advantage of providing only one circulation for adding and mixing fibres, foam formation of the fibrous web, dewatering and recirculation of the drained flow. The degassing (deaeration) makes recirculation easier and more energy efficient, and allows the use of less demanding pumps. Main benefits are thus: a less complicated solution, low capital costs, energy efficiency and adaptation to short fibres of up to 25 mm.

BRIEF DESCRIPTION OF THE DRAWINGS

The accompanying FIG. 1 diagrammatically depicts an installation for producing an absorbent fibre-containing nonwoven sheet material of the present disclosure.

DETAILED DESCRIPTION OF PARTICULAR EMBODIMENTS

Figure 1:
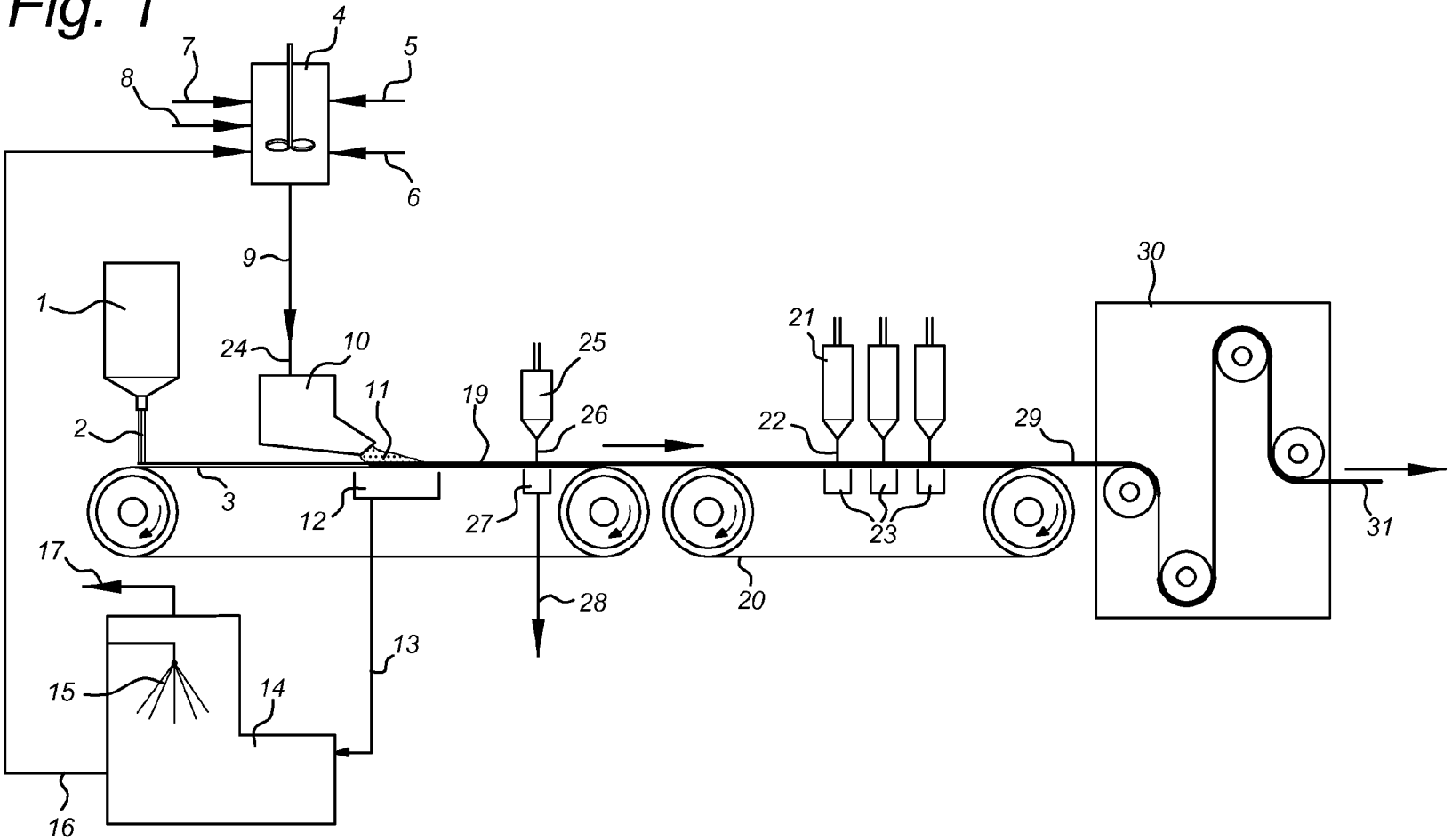

Embodiments of the invention pertain to a process of producing nonwoven materials. Further embodiments of the invention pertain to an apparatus suitable for degassing recycling spent foam from a foam formation process.

The present process of producing a nonwoven sheet material includes the following steps:

a) providing a three-phase (gas-liquid-solid) suspension containing air, water, fibrous material and a surfactant,
b) depositing the suspension onto a moving carrier sieve to produce a fibrous web on the carrier,
c) removing aqueous residue of the suspension through the carrier sieve, d) conveying the aqueous residue through one or more phase separation tanks in an essentially horizontal direction while providing a depressurised headspace above the aqueous residue, e) recycling the aqueous residue resulting from step d) to step a).

In particular embodiments, in step a) of this process, a gas-liquid-solid suspension is prepared in which the air content is between 20 and 50 vol. %, while the air content of the aqueous residue is reduced in step d) to below 20 vol. % for ease of pumping, and the air content is restored to between 20 and 50 vol. % in the mixing step a).

In particular embodiments, the fibrous material of the suspension provided in step a) includes natural and/or man-made fibres, especially short fibres of between 1 and 25 mm average length. Part or all of the natural short fibres may include cellulosic pulp, which can have fibre lengths of between 1 and 5 mm. The cellulosic (pulp) fibres may constitute at least 25 wt. %, 40-95 wt. %, or 50-90 wt. %, of the short fibres to be provided in step a). Instead or in addition, the short fibres may include man-made staple fibres having fibre lengths of between 4 and 25 mm, or between 5 and 20 mm. The staple fibre length may also be bimodal, one part having an average length 5-10 mm and another part having an average length of 15-20 mm. The staple fibres may constitute at least 3 wt. %, or 5-50 wt. % of the short fibres to be provided in step a).

The three-phase suspension can contain a surfactant, in particular a non-ionic surfactant. In particular embodiments, the suspension contains between 0.01 and 0.2 wt. % of surfactant. Further details of the composition and the provision of the suspension are presented below.

The process of the present disclosure can be a high-speed wet-laying process, in which the three-phase suspension can be deposited in step b) at a rate of between 2.1 and 6 $m^3$/min (35-100 l/sec; 126-360 $m^3$/h) for a formed web having a width of 1 m.

In step c), aqueous residue of the suspension is removed through the carrier sieve, for example by suction. In an advantageous embodiment, depositing step b) and removing step c) are repeated after step c) as steps b') and c'), respectively, i.e. the deposition of fibre-containing suspension and the corresponding removal of aqueous residue thereof is performed in two stages: b) and c) followed by b') and c'). Aqueous residue from step c') is also subjected to step d), wherein it is conveyed to one or more phase separation tanks, which can be distinct from the one or more phase separation tanks through which aqueous residue from step c) is conveyed.

The second stage (and even an additional stage if desired) of removal of aqueous residue (c') (and even an additional stage (c") if desired), can be carried out using multiple suction boxes, e.g. 2-3, each one being connected to a distinct phase separation tank. In this embodiment of repeated steps b)+c) and b')+c') the three-phase suspension can be deposited in equal amounts, but the amount in the first step (b) can be larger than in the second step (b'), for example 55-85% in step b) and 15-45% in step b'), the rates corresponding to e.g. 1-5 $m^3$/min for the first deposition and a formed web having a width of 1 m, and 0.3-2.9 $m^3$/min for the second deposition and a formed web having a width of 1 m. This corresponds to depositing about 5-25 kg fibres per min (and per m width) or 6-18 kg fibres per min and per m, and to a carrier sieve running speed of 1-8 m/sec, or 2.5-6 m/sec.

In an embodiment, the present process includes a further step, prior to step b), of depositing a polymer web, which contains at least 50 wt. % of synthetic filaments, in a way known in the art, e.g. by a spun-laid, air-laid or carding process step, and further illustrated below. In another embodiment, the present process includes an optional step of depositing a polymer layer on the deposited (combined) fibrous web after step b). After the deposition of the fibrous web (containing short fibres) and the polymer web, the combined web can contain e.g. between 10 and 60 wt. %, or between 15 and 45 wt. %, of the synthetic filaments on dry matter basis of the combined web.

An important step of the present disclosure is the phase separation of step d), reducing the air content of the aqueous residue (spent web-forming suspension) to below 20 vol. %, below 15 vol. %, or below 10 vol. %. This is achieved by removing and collecting the aqueous residue through the carrier by suction, using a suction box array which can be divided in multiple suction boxes, such as 2-8 suction boxes, or 3-6 suction boxes. Such plurality of suction boxes can also be considered as compartments of a single suction box (array). The suction boxes (or compartments) can be arranged consecutively along the direction of movement of the carrier, and the residue collected in each suction box can advantageously be conveyed to a distinct phase separation tank. A low pressure in the headspace of the separation tanks reduces the air content of the aqueous residue, and at the same time assists in the suction step c). A low pressure can e.g. be an underpressure of 0.05-0.5 bar compared to ambient pressure, the nominal pressure in the separation tanks being in the range of 0.5-0.95 bar, especially 0.8-0.95 bar. Deaeration is further enhanced by breaking the foam, e.g. by introducing turbulence by a fan or by spraying with water. After recycling the deaerated aqueous residue by pumping and entering the foam-producing step a), the air content is restored to the required level, in particular to between 20 and 40 vol. %, in step a). The working of the deaeration is further illustrated below with reference to accompanying FIG. 2.

Thus, in particular embodiments, multiple phase separation tanks, i.e. at least 2, up to e.g. 8, or 3-6, are used, for example one separation tank for each point of suction (suction box) of aqueous residue. If desired, different pressures may be applied in the multiple separation tanks. For instance, the pressure in the headspace of the phase separation tank into which residue from the most upstream (first) of the suction boxes is conveyed may be between 0.01 and 0.1 bar higher than the pressure in the headspace of the phase separation tank into which residue from the most downstream (last) of the suction boxes is conveyed.

The process can contain further steps after step b) of producing a fibrous web on the moving carrier sieve as follows.

Advantageously, the fibrous web as deposited on the moving carrier is subsequently pre-integrated by flushing with water in an additional step f). This can be achieved by using multiple water jets which are arranged essentially perpendicular to the web (in particular vertical). The amount of water can be expressed in relation to amount of suspension applied, the amount then being between 0.0005 and 0.05 $m^3$ of water per $m^3$ of applied suspension, or 0.001-0.03 $m^3$, or 0.002-0.02 $m^3$, or even 0.003-0.01 of water per $m^3$ of suspension. Alternatively, the amount of water applied in step f) can be independently defined relative to the formed sheet material, the amount then being between 0.8 and 20 litres of water per kg of formed sheet material, or between 1 and 10 l/kg, or even between 1.2 and 5 l/kg of formed sheet material. As a further alternative, the amount of water applied in step f) can be expressed in time units, e.g. between 10 and 250 litres of water per min per m width of formed web, or between 13 and 170 l/min.m, or even between 17 and 50 l/min.m. Such amounts of pre-integrating water are especially suitable for a high-speed process as described above. The pressure of the jets can be between 2.5 and 50 bar, between 4 and 20 bar, or between 5 and 10 bar. Spent flushing water is removed through the carrier and can be added to the recycle stream of step e). Prior to the recycle, the removed flushing water can advantageously be conveyed through a further phase separation tank and then fed to step e) or directly to step a). The pre-integrating and removing step f) can also be carried out in at least two stages f1) and f2).

The spent flushing water that is removed in step f) can be used for spraying water through the headspace of the one or more phase separation tanks of step d), in addition to or instead of being recycled to the production of the suspension (pulper); sprayed water can then be collected in the aqueous residue and recycled.

In many instances it will be desirable to further treat the fibrous web. One further treatment is hydroentanglement, in which the fibrous web, as such, or combined with a synthetic continuous filament layer, is integrated by high-pressure water jets. In particular embodiments, the hydroentangling is performed on a different moving carrier sieve from the carrier on which the fibrous web is laid.

Thus, step b) of depositing the three-phase suspension and optional step f) of pre-integrating the deposited web, can be performed on a first moving carrier sieve. The process then additionally includes, after step b), or after step f) if pre-integration is included:

g) transferring the fibrous web from the first moving carrier used in steps b) and c) to a second moving carrier, the second moving carrier having a porosity which is lower than the porosity of the first moving carrier sieve, h) hydroentangling the fibrous web on the second moving carrier, i) drying the hydroentangled sheet;

j) optionally imprinting, conditioning, dimensioning and/or packaging the dried sheet to produce a ready-for-use sheet material.

In step g), the porosities of the first and second moving carrier sieves (wires) can be such that the permeability of the first moving carrier is 250-750 cfm (cubic foot per min) (=7.1-21.2 $m^3$/min), or 400-600 cfm (=11.3-17.0 $m^3$/min), while the permeability of the second moving carrier can be 100-350 cfm (=2.8-9.9 $m^3$/min), or 150-250 cfm (=4.2-7.1 $m^3$/min). Embodiments of steps h), i) and j) are described further below.

The present apparatus for degassing and recycling aqueous residues includes:

(1) one or more dewatering units, a dewatering unit including:

1a. a suction box (12) capable of withdrawing a residual fluid of an aqueous suspension deposited on a carrier sieve through said carrier sieve;

1b. a phase separation tank (14) having a lower section and an upper section, the lower section forming a liquid flow passage and being in fluid connection with said suction box (12) at one side and being in fluid connection with a liquid withdrawal system (16) at an opposite side, the upper section forming a headspace and having a gas outlet, (2) one or more exhausters (17), an exhauster being connected to one or more of the gas outlets of the headspace, and being capable of withdrawing gas from the phase separation tank.

More in particular, the apparatus for degassing and recycling aqueous residues may include:

(1) one or more dewatering units, a dewatering unit including:

1a. a suction box (12) capable of withdrawing and holding a residual fluid of an aqueous suspension deposited on a carrier sieve through said carrier sieve;

a suction line (13) connected to a fluid exit of the suction box;

optionally a valve capable of regulating the fluid flow through the suction line;

1b. a phase separation tank (14) having a lower section and an upper section, the lower section forming a liquid flow passage and being in fluid connection with said suction box (12) through a fluid inlet connected to the suction line (13) at one side, and being in fluid connection with a liquid withdrawal system (16) through a liquid outlet at an opposite side, the upper section forming a headspace and having a gas outlet, the fluid inlet and the liquid outlet being positioned in a manner allowing an essentially horizontal liquid flow through the tank while maintaining the headspace above the liquid, the tank being equipped in such a manner that a sub-atmospheric gas pressure in the tank will enhance the flow of fluid entering the tank from the suction box, 1c. a liquid withdrawal system including a return line (16) connected to the liquid outlet of the phase separation tank (14), capable of returning liquid from the phase separation tank to a common container for aqueous suspension, a pump (18) capable of withdrawing liquid from the phase separation tank through the return line (16);

a valve capable of regulating the liquid flow through the return line;

(2) one or more exhausters, an exhauster being connected to one or more of the gas outlets of the one or more phase separation tanks through a gas exit line (17) and capable of withdrawing gas from the phase separation tank, the gas exit line optionally including a valve capable of regulating the gas flow through exit lines.

The phase separation tank can be equipped with a means for promoting breakdown of the foam, such as a fan or a sprayer. In case of a sprayer, the tank further includes (iv) a spray liquid inlet and (v) a spraying device connected to the spray liquid inlet, the spraying device (v) being capable of spraying aqueous liquid in the headspace of the tank. The spray liquid can be an aqueous liquid, i.e. largely or wholly consisting of water, possibly containing agents assisting in breaking the foam.

There can be a single dewatering unit, but, in particular embodiments, there is a plurality, i.e. two or more. The plurality of dewatering units can be from 2 up to e.g. 8, or even up to 10. In certain embodiments, the apparatus has 3-6 dewatering units.

The apparatus can further include a modified dewatering unit instead of one of or in addition to the plurality of dewatering units. In the modified dewatering unit, a suction box is capable of withdrawing flushing water from a flushing (pre-integration) device to be used in step f) described above. The unit can further include a further exhauster, which is connected to the gas exit line of the modified dewatering unit and which may not be connected to at least one of the gas exit lines of the plurality of dewatering units.

In the present disclosure, the indications "between x and y" and "from x to y" and "of x-y", wherein x and y are numerals, are considered to be synonymous, the inclusion or exclusion of the precise end points x and y being of theoretical rather than practical meaning.

Further details of particular embodiments of the various steps and materials to be applied are described below.

Materials and Process Steps

Carrier and Polymer Web

A moving carrier sieve on which the aqueous composition can be applied, can be a forming fabric, which can be a running belt-like wire having at least the breadth of the sheet material to be produced, which fabric allows draining of liquid through the fabric, i.e. which is semipermeable. In an embodiment, a polymer web can first be deposited on the carrier by laying man-made fibres on the carrier. The fibres can be short or long distinct (staple) fibres and/or continuous filaments. The use or co-use of filaments is preferred in certain embodiments. In another embodiment, a polymer layer can be deposited on the fibrous web obtained in steps b) and c), but before step g). It is also possible to first deposit a polymer layer, followed by depositing the aqueous suspension to form a fibrous web on the polymer web and to deposit a further polymer layer on the fibrous web.

Filaments are fibres that in proportion to their diameter are very long, in principle endless, during their production. They can be produced by melting and extruding a thermoplastic polymer through fine nozzles, followed by cooling, for example using an air flow, and solidification into strands that can be treated by drawing, stretching or crimping. The filaments may be of a thermoplastic material having sufficient coherent properties to allow melting, drawing and stretching. Examples of useful synthetic polymers are polyolefins, such as polyethylene and polypropylene, polyamides such as nylon-6, polyesters such as poly(ethylene terephthalate) and polylactides. Copolymers of these polymers may of course also be used, as well as natural polymers with thermoplastic properties. Polypropylene is a particularly suitable thermoplastic man-made fibre. Fibre diameters can e.g. be in the order of 1-25 μm. Staple fibres can be of the same man-made materials as filaments, e.g. polyethylene, polypropylene, polyamides, polyesters, polylactides, cellulosic fibres, and can have lengths of e.g. 2-40 mm. In particular embodiments, the polymer web contains at least 50 wt. % of thermoplastic (synthetic) filaments, or at least 75 wt. % of synthetic filaments. The combined web contains between 15 and 45 wt. % of the synthetic filaments on dry solids basis of the combined web.

a. Three-Phase Fibre Suspension

The aqueous suspension is obtained by mixing short fibres and water in a mixing tank. The short fibres can include natural fibres, in particular cellulosic fibres. Among the suitable cellulosic fibres are seed or hair fibres, e g cotton, flax, and pulp. Wood pulp fibres are especially well suited, and both softwood fibres and hardwood fibres are suitable, and also recycled fibres can be used. The pulp fibre lengths can vary between 0.5 and 5, from 1 to 4 mm, or from around 3 mm for softwood fibres to around 1.2 mm for hardwood fibres and a mix of these lengths, or even shorter, for recycled fibres. The pulp can be introduced as such, i.e. as pre-produced pulp, e.g. supplied in sheet form, or produced in situ, in which case the mixing tank is commonly referred to as a pulper, which involves using high shear and possibly pulping chemicals, such as acid or alkali.

In addition to or instead of the natural fibres, other natural or man-made materials can be added to the suspension, such as in particular other short fibres. Staple (man-made) fibres of variable length, e.g. 5-25 mm, can suitably be used as additional fibres. The stable fibres can be man-made fibres as described above, e.g. polyolefins, polyesters, polyamides, poly(lactic acid), or cellulose derivatives such as lyocell. The staple fibres can be colourless, or coloured as desired, and can modify further properties of the pulp-containing suspension and of the final sheet product. Levels of additional (man-made) fibres, in particular staple fibres, can suitably be between 3 and 100 wt. %, between 5 and 50 wt. %, between 7 and 30 wt. %, or between 8 and 20 wt. % on the basis of the dry solids of the aqueous suspension.

When using polymer fibres as additional material, it is usually necessary to add a surfactant to the pulp-containing suspension. Suitable surfactants include anionic, cationic, non-ionic and amphoteric surfactants. Suitable examples of anionic surfactants include long-chain (Ic) (i.e. having an alkyl chain of at least 8 carbon atoms, in particular at least 12 carbon atoms) fatty acid salts, Ic alkyl sulfates, Ic alkylbenzenesulfonates, which are optionally ethoxylated. Examples of cationic surfactants include Ic alkyl ammonium salts. Suitable examples of non-ionic surfactants include ethoxylated Ic fatty alcohols, ethoxylated Ic alkyl amides, Ic alkyl glycosides, Ic fatty acid amides, mono- and diglycerides etc. Examples of amphoteric (zwitterionic) surfactants include Ic alkylammonio-alkanesulfonates and choline-based or phosphatidylamine-based surfactants. The level of surfactant (on the basis of the aqueous suspension) can be between 0.005 and 0.2, between 0.01 and 0.1, or between 0.02 and 0.08 wt. %.

For an effective application of the aqueous suspension the suspension contains air, i.e. it is a three-phase suspension used as a foam. The amount of air introduced into the suspension (e.g. by stirring the suspension) can be between 15 and 60 vol. % of the final suspension (including the air). The air content of the three-phase suspension can be between 20 and 50 vol. %, between 20 and 45 vol. %, between 25 and 40 vol. %, or between 30 and 38 vol. %. The more air is present in the foam, often the higher levels of surfactants are required. The term "air" is to be interpreted broadly as any non-noxious gas, typically containing at least 50% of molecular nitrogen, and further varying levels of molecular oxygen, carbon dioxide, noble gases etc. Further information about foam formation as such can be found e.g. in WO03/040469.

b. Deposition of the Fibre Suspension

The aqueous suspension containing short fibres is deposited on the carrier, either directly or on a polymer web, e.g. using a head box, which guides and spreads the suspension evenly over the width of the carrier or the web in the direction of the running fabric, causing the suspension to partly penetrate into the polymer web. The speed of application of the aqueous suspension, which is the running speed of the moving carrier sieve (wire) and thus typically the same as the speed of laying the polymer web, can be high, e.g. between 1 and 8 m/sec (60-480 m/min), especially between 3 and 5 m/sec.

The aqueous suspension can also be deposited in two or more stages (b) and (b'), by using two or more head boxes. Where a polymer web is first applied, the aqueous fibre suspension can be applied onto the polymer web in two or more separate steps at the same side of the polymer web. This results in part of the solids of the suspension entering on and in the polymer web as a result of the deposition and subsequent removal of surplus water and air, and consequently the remaining part(s) of the suspended solids to be even more evenly spread over the width of the web.

The total amount of liquid circulated by the wet-laying or foam laying for a formed web having a width of 1 m can be in the order of 1200-5400 kg/min, 1800-4500 kg/min, or 2100-3600 kg/min (20-90, 30-75, or 35-60 kg/sec). In case of two deposition stages, e.g. between 25 and 90, in particular between 50 and 85% may be applied in the first stage, and the remaining part in the second and optional further stages. The amount that is drained off via the web having a width of 1 m, i.e. the part that is not recycled, will be in the order of 20-57 kg/min of liquid (36-66 kg/min including solid material).

c-d-e. Removal and Recycling of Aqueous Residue after the Application of the Suspension Surplus liquid and gas phases are sucked through the web and the fabric in step c), leaving the short fibres and other solids in and on the web. The spent liquid and gas are separated, and processed according to the present disclosure and, in particular embodiments, the liquid having an air content below 20 vol. %, or below 15 vol. %, is returned to the mixing tank for producing fresh aqueous fibre suspension, as described in more detail below.

When the aqueous fibre suspension is applied in two or more separate steps (b), b') and possibly b"), etc.), using two or more head boxes, the laying steps are separated by a suction step c) and followed by a suction step (c', c"). The removal of aqueous residue in the first removal step c) can be such that the water content of the combined web before the second pulp application step is not more than 85 wt. %, or between 60 and 75 wt. %. Thus, the dry solids content of the fibrous web after the first application step can be at least 15 wt. %, or between 25 and 40 wt. %. Where two or more removal steps are applied following distinct deposition steps, each removal step can be performed using multiple suction boxes, each suction box optionally being connected to a distinct phase separation tank. Advantageously, 2-5 suction boxes are used for the first removal step c), and 1-3 suction boxes are used for the second removal step c'), and e.g. 1-2 suction boxes for a third or further removal step c").

f. Pre-Integrating

After the formation of the fibrous web, optionally combined with a polymer web, the fibrous web can be subjected, in a particular embodiment, to pre-integration, by flushing (rinsing) the web with water jets, in particular at a level of e.g. 0.001-0.03 $m^3$ of water per $m^3$ of applied three-phase suspension, or at a differently defined rate as described above with reference to step f). The water jets can form a row of perpendicular (vertical) jets covering the width of the moving web and can have a pressure of 2.5-50 bar. The water used for pre-integration can be fresh water, having low dissolved matter levels. Part of the water can be supplied by recycling flushed water, optionally after (micro)filtration. In an embodiment, part of the collected flushed water is fed to the aqueous suspension in step a) and the remainder of the collected flushed water is recycled to the pre-integration step f).

The pre-integrating and collecting step f) may be carried out in multiple stages, e.g. two stages f1) and f2), or even three stages f1), f2), f3), or even more stages, using multiple series of water jets, each series covering the entire width of the web forming the sheet material. In the event of multiple pre-integration stages, it may be advantageous to recycle flushed water collected from the first stage f1), which will contain relatively high levels of surfactant, to the three-phase (foam) suspension in step a) and at least a part of the flushed water collected from the second or last stage f2), which will contain lower levels of surfactant, to the first pre-integration step f1). The more specific distribution of collected flushed water to the suspension-forming stage and to the pre-integration, can be chosen so as to have optimum quality of the suspension and the pre-integrating water in combination with minimum use of raw materials, including water and surfactant.

g. Hydroentangling

Subsequently to the wet-laying or foam-laying steps b) and c), the fibrous web can be subjected to hydroentanglement, i.e. to needle-like water jets covering the width of the running web. In particular embodiments, the hydroentangling step (or steps) is performed on a different carrier (running wire), which is more dense (smaller sieve openings) than the carrier on which the fibre-containing suspensions (and optionally first the polymer web) are deposited. In certain embodiments, the hydroentangling step includes the use of multiple hydroentanglement jets shortly sequencing each other. The pressure applied may be in the order of 20-200 bar. The total energy supply in the hydroentangling step may be in the order of 100-400 kWh per ton of the treated material, measured and calculated as described in CA 841938, pages 11-12. The skilled person is aware of further technical details of hydroentanglement, as described e.g. in CA 841938 and WO96/02701.

h. Drying

The combined, hydroentangled web can be dried, e.g. using further suction and/or oven drying at temperatures above 100° C., such as between 110 and 150° C.

i. Further Processing

The dried nonwoven can be further treated by adding additives, e.g. for enhanced strength, scent, printing, colouring, patterning, impregnating, wetting, cutting, folding, rolling, etc. as determined by the final use of the sheet material, such as in industry, medical care, household applications.

End Product

The nonwoven sheet material as produced can have any shape, but frequently it will have the form of rectangular sheets of between less than 0.5 m up to several meters. Suitable examples include wipes of 40 cm×40 cm. Depending on the intended use, it may have various thicknesses of e.g. between 100 and 2000 μm, or from 250 to 1000 μm. The thickness can be determined as described below. Along its cross-section, the sheet material may be essentially homogenous, or it may gradually change from relatively pulp-rich at one surface to relatively pulp-depleted at the opposite surface (as a result of e.g. wet-laying or foam-laying pulp at one side of the polymer web only), or, alternatively, from relatively pulp-rich at both surfaces to relatively pulp-depleted in the centre (as a result of e.g. wet-laying or foam-laying pulp at both sides of the polymer web—either or both in multiple steps at the same side). In a particular embodiment, the nonwoven material as produced has front and back surfaces of different composition, in that the pulp-containing suspension is applied at the same side in each separate step, and/or hydroentanglement is performed only at one side. Other structures are equally feasible, including structures not containing filaments.

The composition can also vary within rather broad ranges. As an advantageous example, the sheet material may contain between 25 and 85 wt. % of (cellulosic) pulp, and between 15 and 75 wt. % of man-made (non-cellulosic) polymer material, whether as (semi)continuous filaments or as relatively short (staple) fibres, or both. In a more detailed example, the sheet material may contain between 40 and 80 wt. % of pulp, between 10 and 60 wt. % of filaments and between 0 and 50 wt. % of staple fibres, or, more particular examples, between 50 and 75 wt. % of pulp, between 15 and 45 wt. % of filaments and between 3 and 15 wt. % of staple fibres. As a result of the present process, the nonwoven sheet material has few if any deficiencies, combined with low residual levels of surfactant. In particular embodiments, the end product contains less than 75 ppm of the surfactant, less than 50 ppm, or less than 25 ppm of (water-soluble) surfactant. All these contents are on dry matter basis, unless otherwise specified.

FIGURES

The accompanying FIG. 1 shows equipment for carrying out the process described herein. If used, thermoplastic polymer is fed into a heated drawing device 1 to produce filaments 2, which are deposited on a first running wire 3 to form a polymer layer. A mixing tank 4 has inlets for pulp 5, staple fibre 6, air 7, water 8, and surfactant (not shown). The resulting pulp-containing suspension (foam) 9 is fed to the head box 10 through inlet 24. A suction box 12 (or a plurality thereof) below the moving wire removes most of the liquid (and gaseous) residue of the spent pulp-containing suspension, which is fed to one or more phase separation tanks 14 (only one shown), through line 13, equipped with a valve. The suspension is allowed to degas in the phase separation tank by an underpressure (vacuum) produced by a gas exhauster (not shown) in gas exit (line) 17. Sprayer 15 is provided in the headspace of the phase separation tank to enhance the phase separation by spraying water on the foam, thereby breaking the foam. The resulting aqueous liquid is returned to the mixing tank through line 16. A pre-integration device 25 can produce a water jet 26 for pre-integrating the combined web 19, and the spent water is collected in suction box 27 and carried off through line 28, ultimately to the mixing tank 4. The combined pulp-polymer web 19 can be transferred to a second running wire 20 and subjected to multiple hydroentanglement steps through devices 21 producing water jets 22, with water suction boxes 23, the water being discharged and further recycled (not shown). The hydroentangled web 29 is then dried in drier 30 and the dried web 31 is further processed (not shown).

Figure 2:
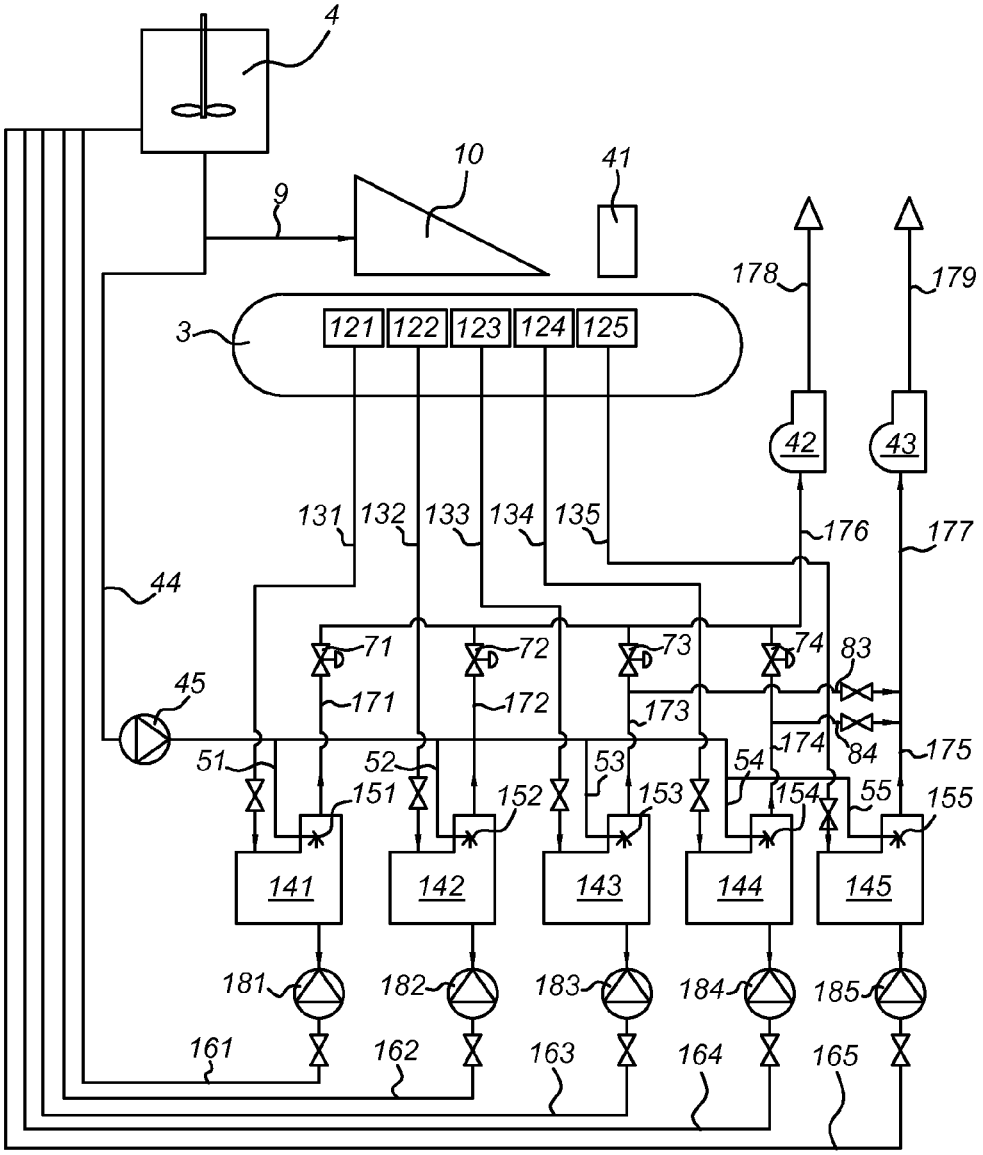
FIG. 2 diagrammatically shows the phase separation process and equipment used in the production of the sheet material in more detail.

FIG. 2 illustrates the cycle of the three-phase suspension including the deaeration process and equipment in more detail. In the figures, the same elements or parts have the same reference numerals. FIG. 2 shows a set of four suction boxes 121-124 below the moving carrier 3 and the head box 10. The four suction boxes collect essentially all aqueous residue passing the moving sieve. The collected residues are conveyed to the corresponding separation tanks 141-144, via lines 131-134, which are equipped with controllable valves. The separation tanks have liquid outlet lines 161-164 provided with pumps 181-184 at a lower part of the tanks and gas outlet lines 171-174 at an upper part of the tank. The gas outlet lines 171-174 are provided with control valves 71-74 and are combined to a gas line 176, a vacuum fan 42 and a gas exhaust 178. The tanks 141-144 are furthermore provided with sprayers 151-154, fed with spraying liquid—in this example aqueous suspension supplied through line 44 and valve 45—, through lines 51-54. A flushing device 41 (equivalent to pre-integration device 25 of FIG. 1) produces water jets for flushing the web and the flushed water is collected by suction box 125, fed to a fifth separation tank 145 through line 135 having a controllable valve. Tank 145 is also provided with sprayer 155 fed through line 55, liquid outlet 165 for water, driven by pump 185, and gas outlet 175, which connects to a second vacuum fan 43 through combined line 177 and then to exhaust 179. Underpressure in the tanks provoking the withdrawal of aqueous residue from the suction boxes to the separation tanks is secured by vacuum fans or pumps 42 and 43. Connecting lines 83 and 84 provided with control valves connect gas outlets 173 and 174 of separation tanks 143 and 144, respectively, with the second vacuum fan 43, so as to allow the more downstream separation tanks 143 and 144 to be evacuated by fan 43 instead of, or in addition to, fan 42. The liquid lines 161-165 convey the deaerated aqueous residue to the pulper 4, by pumps 181-185, in which the constituents of the three-phase suspension are mixed in the appropriate amounts.

The Figures only serve to illustrate an embodiment of the invention and do not limit the claimed invention in any way. The same applies to the Examples below.

EXAMPLES AND TEST METHODS

Test methods used for determining properties and parameters of the nonwoven material as described herein will now be explained in more detail. Also, a test method for measuring air content of the three-phase foam-forming suspension is presented.

Furthermore, some examples illustrate advantages of using the method as defined in the appended claims and the product provided by such method are presented below.

Test Method—Thickness

The thickness of a sheet material as described herein can be determined by a test method following the principles of the Standard Test Method for Nonwoven Thickness according to EDANA, WSP 120.6.R4 (12). An apparatus in accordance with the standard is available from IM TEKNIK AB, Sweden, the apparatus having a Micrometer available from Mitutoyo Corp, Japan (model ID U-1025). The sheet of material to be measured is cut into a piece of 200×200 mm and conditioned (23° C., 50% RH, hours). The measurement should be performed at the same conditions. During measurement the sheet is placed beneath the pressure foot which is then lowered. The thickness value for the sheet is then read after the pressure value is stabilised. The measurement is made by a precision Micrometer, wherein a distance created by a sample between a fixed reference plate and a parallel pressure foot is measured. The measuring area of the pressure foot is 5×5 cm. The pressure applied is 0.5 kPa during the measurement. Five measurements could be performed on different areas of the cut piece to determine the thickness as an average of the five measurements.

Test Method—Air Content

Equipment

A spiral connected to an inlet for foam, air or water and a corresponding outlet, the spiral having volume of 2 l. The spiral is placed on a scale/balance.

Calibration

Calibration is done by emptying the spiral by blowing compressed air through it and zero setting value of the scale when it is empty, i.e. only filled with air, which is balanced to the calibrated value of zero (0), i.e. 0 vol. % liquid present in the spiral. The spiral is then filled with water and the weight of this water is determined, which gives the calibrated value of 100, i.e. 100 vol. % of liquid present in the spiral.

Measurement

An emptied spiral is filled with the suspension/foam to be tested and weighed and the weight is linearly correlated to the calibrated 0 and 100 end values representing the volume percentage of liquid present in the spiral. Thus, the measured value corresponds to the percentage of liquid part of the foam. The air content is then calculated as the remaining percentage so as to sum up to 100 percent in total.

Example 1

An absorbent sheet material of nonwoven that may be used as a wipe such as an industrial cleaning cloth was produced by laying a web of polypropylene filaments on a running conveyor fabric and then applying on the polymer web a pulp dispersion containing about 0.5 wt. % of a 88:12 weight ratio of wood pulp and polyester staple fibres. The staple fibres contained a mixture of 1.7 dtex fibres with two different lengths, namely 50 wt. % of the fibres having a length 6 mm and 50 wt. % of the fibres having a length 18 mm. The dispersion further included about 0.03 wt. % of a non-ionic surfactant (ethoxylated fatty alcohol) by foam forming in a head box, introducing a total of about 30 vol. % of air (on total foam volume). For the foam formation loop, an installation as diagrammatically depicted in FIG. 2 was used, involving multiple separation units for deaerating the spent foaming suspension. The air content of the aqueous suspension leaving the deaeration unit was about 10% by volume. The foam cycle in the loop was about 3000 kg/min per m width of formed web; the width of the freshly wet-laid web was about 1.4 m. The weight proportion of the polypropylene filaments was 25 wt. % on dry weight basis of the end product. The amounts were chosen so as to arrive at a basis weight of the end product of 55 g/m$^2$. The combined fibre web was then subjected to hydroentanglement using multiple water jets at increasing pressures of 40-100 bar providing a total energy supply at the hydroentangling step of about 180 kWh/ton as measured and calculated as described in CA 841938, pp. 11-12 and subsequently dried. The speed of wind-up of the dried sheet of 1.3 m width was 225 m/min.

What is claimed is:

1. A process of producing a nonwoven sheet material of natural and/or man-made fibres, comprising:

a) providing a three-phase (gas-liquid-solid) suspension containing:
   water, natural fibers, man-made fibres, or both natural fibers and man-made fibers,
   a surfactant, and
   20-50 volume % of air, b) depositing the suspension onto a moving carrier sieve to produce a fibrous web on the carrier sieve, c) removing aqueous residue of the suspension through the carrier sieve, and e) recycling the aqueous residue to step a), wherein the aqueous residue, before step e), is subjected to a step d) of phase separation, in which the aqueous residue is conveyed through one or more phase separation tanks in an essentially horizontal direction while providing a depressurised headspace above the aqueous residue, the phase-separation resulting in reducing an air content of the aqueous residue to below 20 volume %.

2. The process according to claim 1, wherein conveying the aqueous residue through the one or more separation tanks comprises breaking a foam.

3. The process according to claim 1, wherein the aqueous residue is removed through the carrier sieve by two or more suction boxes, the suction boxes being arranged consecutively along the direction of movement of the carrier sieve, the residue collected in each suction box being conveyed to a distinct phase separation tank.

4. The process according to claim 1, wherein, subsequently after step c), steps b) and c) are repeated as steps b') and c'), respectively, such that the step b') subsequent depositing of the suspension occurs onto the fibrous web deposited on the carrier sieve at steps b) and c), and aqueous residue from step c') is subjected to step d), wherein the aqueous residue from step c') is conveyed through one or more phase separation tanks.

5. The process according to claim 4, wherein the one or more phase separation tanks through which the aqueous residue from step c') is conveyed are distinct from the one or more phase separation tanks through which aqueous residue from step c) is conveyed.

6. The process according to claim 1, further comprising:

f) the fibrous web produced in steps a) through c) is subsequently subjected to pre-integration by flushing with water, spent flushing water being removed through the carrier sieve.

7. The process according to claim 6, wherein removed flushing water is conveyed through a further phase separation tank and then fed to step a).

8. The process according to claim 6, which further comprises, after step f):

g) optionally transferring the fibrous web from said moving carrier sieve, being a first moving carrier sieve, to a second moving carrier sieve, said second moving carrier sieve having a porosity which is smaller than the porosity of said first moving carrier sieve, h) hydroentangling the fibrous web on said second moving carrier sieve, i) drying the hydroentangled sheet and optionally imprinting, conditioning, dimensioning and/or packaging the dried sheet to produce a ready-for-use sheet material.

9. The process according to claim 1, further comprising:

f) the fibrous web produced in steps a) through c) is subsequently subjected to pre-integration by flushing with water, spent flushing water being removed through the carrier sieve, and wherein flushing the fibrous web with the amount of water includes spraying at least a portion of the spent flushing water through the headspace of the one or more phase separation tanks of step d) and the amount of water is collected in the aqueous residue.

10. The process according to claim 1, which further comprises, after step b):

g) optionally transferring the fibrous web from said moving carrier sieve, being a first moving carrier sieve, to a second moving carrier sieve, said second moving carrier sieve having a porosity which is smaller than the porosity of said first moving carrier sieve, h) hydroentangling the fibrous web on said second moving carrier sieve, i) drying the hydroentangled sheet and optionally imprinting, conditioning, dimensioning and/or packaging the dried sheet to produce a ready-for-use sheet material.

11. The process according to claim 1, wherein the suspension contains between 0.01 and 0.2 weight % of surfactant.

12. The process according to claim 1, wherein the surfactant is a non-ionic surfactant.

13. The process according to any claim 1, wherein fibrous material in the suspension comprises short fibres of between 1 and 25 mm millimeters length, and includes at least 25 weight % of cellulosic pulp having fibre lengths of between 1 and 5 millimeters.

14. The process according to claim 1, wherein the three-phase suspension contains between 20 and 45 volume % of air.

15. The process according to claim 1, wherein the three-phase suspension is deposited in step b) at a rate of between 2100 and 6000 Liters per minute per meter width of produced fibrous web.

16. The process according to claim 1, wherein prior to step b), a polymer web is deposited on the first carrier sieve, wherein the polymer web contains at least 50 wt. % of synthetic filaments, and the combined web resulting from the deposition of the pulp-containing suspension onto the polymer web contains between 15 and 45 weight % of the synthetic filaments on dry matter basis of the combined web.

17. The process according to claim 1, wherein upstream from step b), a polymer web is deposited on the first carrier sieve.

18. The process according to claim 17, wherein the polymer web contains at least 50 weight % of synthetic filaments, and the combined web resulting from the deposition of the pulp-containing suspension onto the polymer web contains between 15 and 45 weight % of the synthetic filaments on dry matter basis of the combined web.

19. The process according to claim 17, wherein a polymer included in the polymer web is selected from a group consisting of a polyolefin, a polyamide, a polyester, and combinations thereof.

20. The process according to claim 17, wherein the polymer web comprises a thermoplastic fibre.

* * * * *